US007275747B1

(12) United States Patent
Tanita

(10) Patent No.: US 7,275,747 B1
(45) Date of Patent: Oct. 2, 2007

(54) DART BOARD GAME KIT AND ASSOCIATED METHOD FOR PLAYING THE GAME

(76) Inventor: Thomas A. Tanita, 2296 N. Lyndhurst Ave., Camarillo, CA (US) 93010

( * ) Notice: Subject to any disclaimer, the term of this patent is extended or adjusted under 35 U.S.C. 154(b) by 275 days.

(21) Appl. No.: 11/045,367

(22) Filed: Jan. 31, 2005

(51) Int. Cl.
*F41J 3/00* (2006.01)

(52) U.S. Cl. ..... 273/408; 273/409

(58) Field of Classification Search ..... 273/371–377, 273/403, 404, 407, 408, 409; D21/307, 308
See application file for complete search history.

(56) References Cited

U.S. PATENT DOCUMENTS

| | | | | |
|---|---|---|---|---|
| D95,517 | S | * | 5/1935 | LaBorie ..... D21/308 |
| D250,215 | S | * | 11/1978 | Elliot ..... D21/308 |
| 4,314,703 | A | | 2/1982 | Grottola |
| 4,913,444 | A | | 4/1990 | Hatt |
| 5,020,807 | A | | 6/1991 | Barkley |
| 5,197,743 | A | | 3/1993 | Hanson, Jr. |
| 5,540,446 | A | * | 7/1996 | Felsen ..... 273/403 |
| 5,558,337 | A | | 9/1996 | Frank, III |
| 5,613,684 | A | * | 3/1997 | Gittens et al. ..... 273/348.3 |
| D412,185 | S | | 7/1999 | Kelley |
| 5,975,530 | A | | 11/1999 | Gary |

FOREIGN PATENT DOCUMENTS

| | | | |
|---|---|---|---|
| GB | 2194740 A | * | 3/1988 |
| WO | WO9412846 | * | 6/1994 |

* cited by examiner

*Primary Examiner*—Mark S Graham

(57) ABSTRACT

A dart-board game kit includes an annular target including a front surface provided with predetermined surface indicia imprinted thereon for defining a plurality of pie-shaped regions at which players may aim. The front target surface has at least one concentric circle and a coaxially registered bulls-eye provided with a diameter smaller than a diameter of each concentric circle. A plurality of projectiles are removably engageable with the front surface. The dart-board game kit further includes a set of playing rules informing players how to play the game. Each player is required to stand a predetermined distance from the target when throwing the projectiles and each player is required to score hits in the regions of the target. The players continue to throw the projectiles until attaining an acceptable goal or reaching a maximum number of throws.

2 Claims, 5 Drawing Sheets

DART BOARD GAME KIT AND ASSOCIATED METHOD FOR PLAYING THE GAME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to games and, more particularly, to a dart board game kit and associated method of playing.

2. Prior Art

Dart games have come to us from antiquity. The conventional, modern dart game employs a board which is separated by radial extending rays and circumferential rings. The scoring areas thus defined have different score values, with numerical score values circularly marked around the scoring areas, and with the circumferential rings separating the score areas into score multiple values.

Such a game is interesting, and many people are involved it, but on an informal basis and on a tournament basis. However, games employing the standard dart board are limited to those in which numerical scoring serves as the basis of the game. A competitive game such as darts would make an excellent motivational tool for employers seeking to encourage increased sales and productivity in a friendly, but competitive manner.

Accordingly, a need remains for a dart game in which more versatility in game playing rules and ingenuity are achieved. Such a game could simulate playing the game of golf, or could assist an employer in improving employee morale by providing education to employees playing the game, for example. Such a game could also be used to enhance productivity among salespeople as well as promote social interactions among a company's employees. The game would be fun, competitive in nature, and easy to play. By throwing darts at a target representing specific goals, employers could make the motivational process fun for all involved.

BRIEF SUMMARY OF THE INVENTION

In view of the foregoing background, it is therefore an object of the present invention to provide a customizable dart-board game kit for promoting employee morale. These and other objects, features, and advantages of the invention are provided by a dart-board game kit including an annular target including a front surface provided with predetermined surface indicia imprinted thereon for defining a plurality of pie-shaped regions at which players may aim. The regions are associated with a selected category unique to a business industry. The front target surface has at least one concentric circle and a coaxially registered bulls-eye provided with a diameter smaller than a diameter of each concentric circle. The target further includes a handle having opposed end portions attached to an outer perimeter of the target such that the target can be vertically supported at an elevated position during game playing conditions.

A plurality of mobile identification markers are selectively attachable to the regions for further defining a parameter of the business category for which each player must strive and each business goal is tailored to the business industry and company policies of the player's employer. The identification markers include unique surface indicia displayed on front and rear surfaces thereof such that the dart game can be tailored according to the business industry categories.

A plurality of projectiles are removably engageable with the front surface. Each projectile is assigned to an associated player such that a multitude of players can simultaneously track their goals on the target.

The dart-board game kit further includes a set of playing rules informing players how to play the game. Each player is required to stand a predetermined distance from the target when throwing the projectiles and each player is required to score hits in the regions of the target corresponding to their employment category with their employer. The players continue to throw the projectiles until attaining an acceptable goal or reaching a maximum number of throws. Such a dart game preferably does not identify a winner, but rather improves employee motivation and work-related standards. A plurality of rectangular signs may be adjustably positional on a ground surface and at selected distances from the target for designating where each player must stand while throwing the projectiles at the target.

The target may further include a rear surface provided with surface indicia identifying a plurality of pie-shaped segments associated with a plurality of golf course holes. The pie-shaped segments are preferably registered about a center of the rear surface and further are displayed in a chronological and clockwise order. Each of the pie-shaped segments may further be parted along a radial path and define a plurality of adjacently disposed portions having an associated numerical value identifying a number of swings for completing one of the golf course holes. The numerical values preferably linearly increase towards the center of the rear surface with the center representing a hole-in-one. Selected ones of the portions are preferably juxtaposed along the outer perimeter of the target and further define at least one action selected from the group including hitting a golf ball into a body of water, hitting a golf ball out of bounds, and a 2-stroke penalty respectively.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
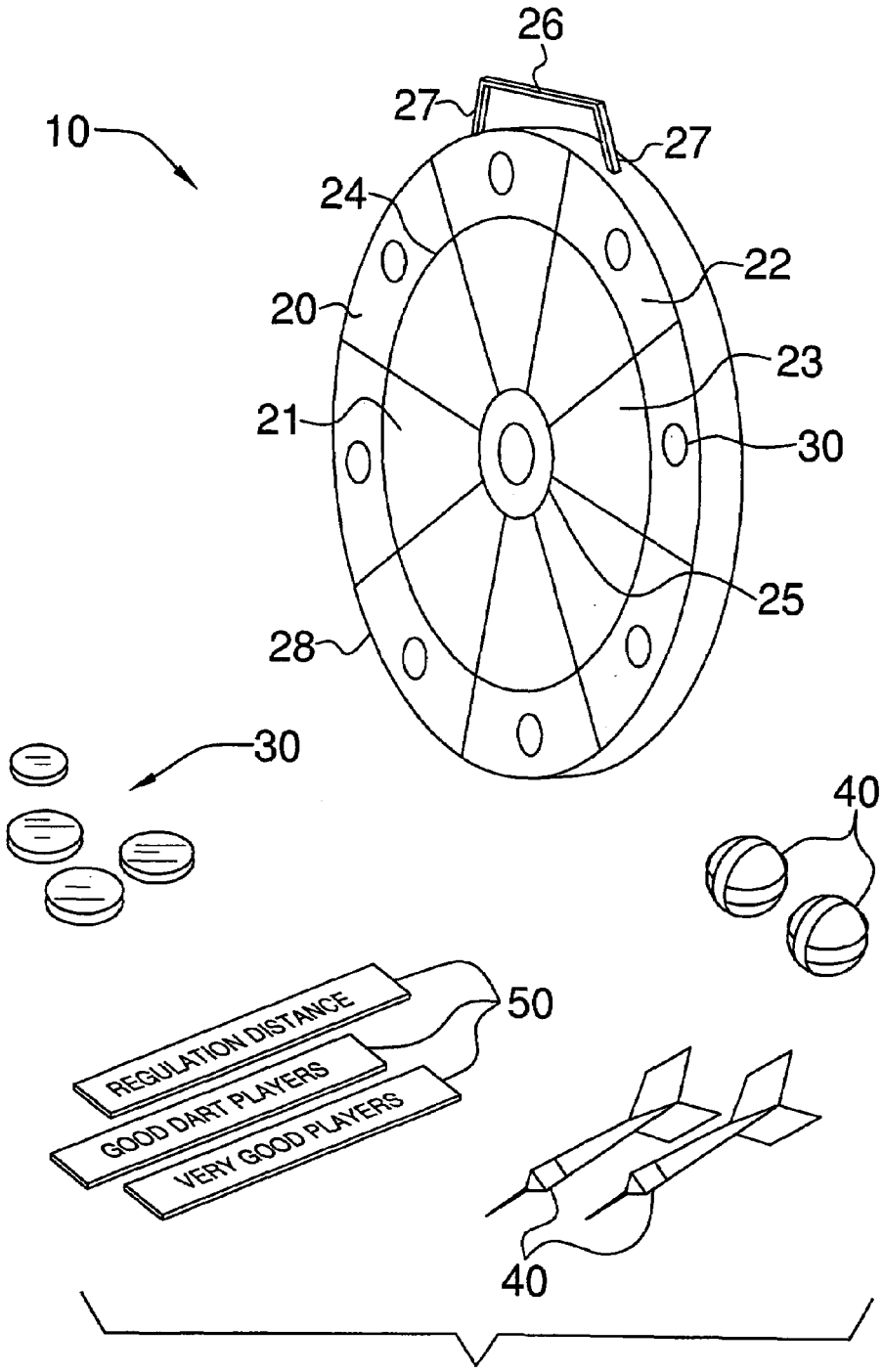
FIG. 1 is a perspective view showing a dart-board game kit and associated projectiles and markers, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a dart-board game and associated method of playing. It should be understood that the dart-board game kit 10 may be used to play many different types of games and should not be limited to use as a conventional dart-board game.

Figure 3:
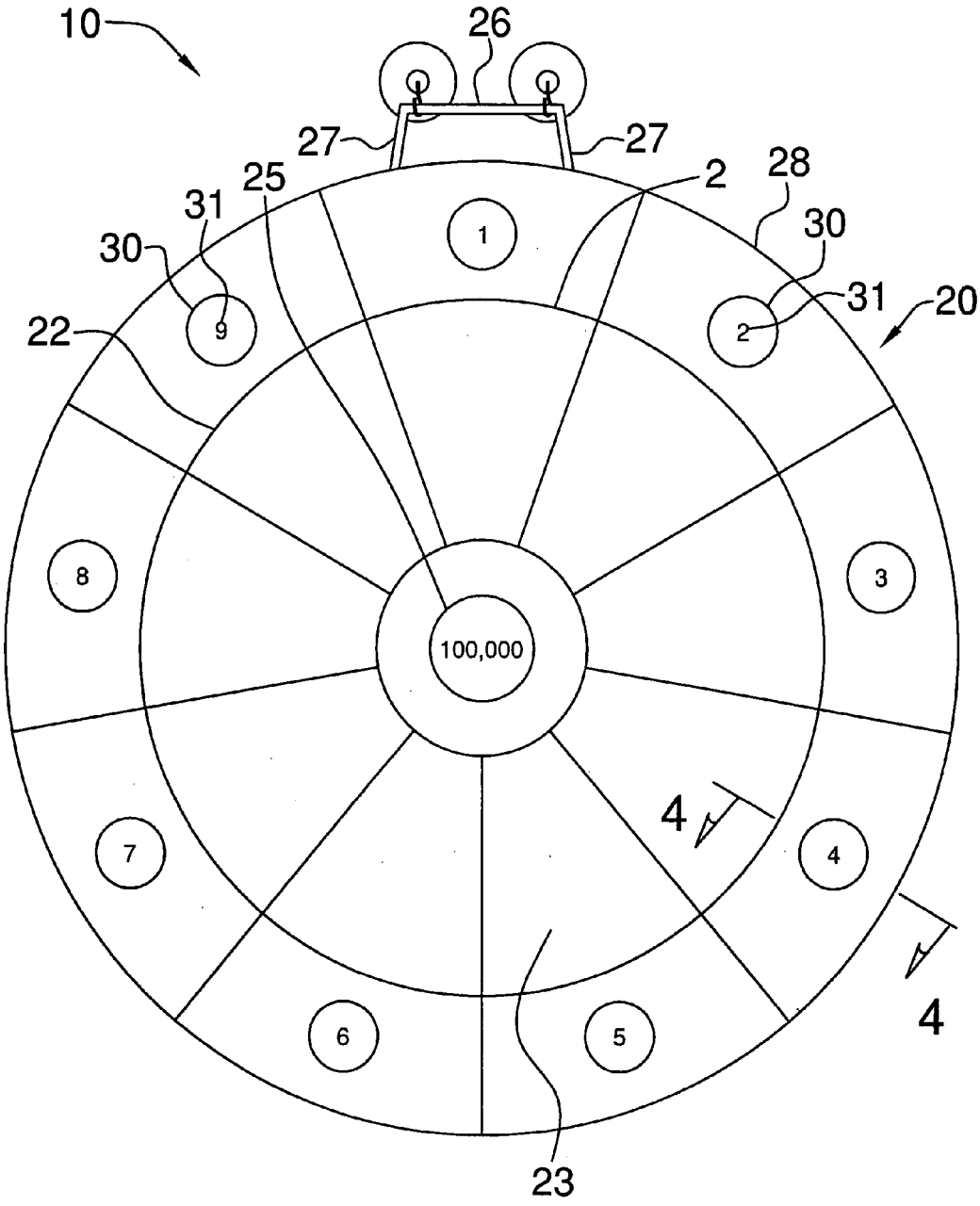
FIG. 3 is an enlarged front elevational view of the target shown in FIG. 1.
Figure 5:
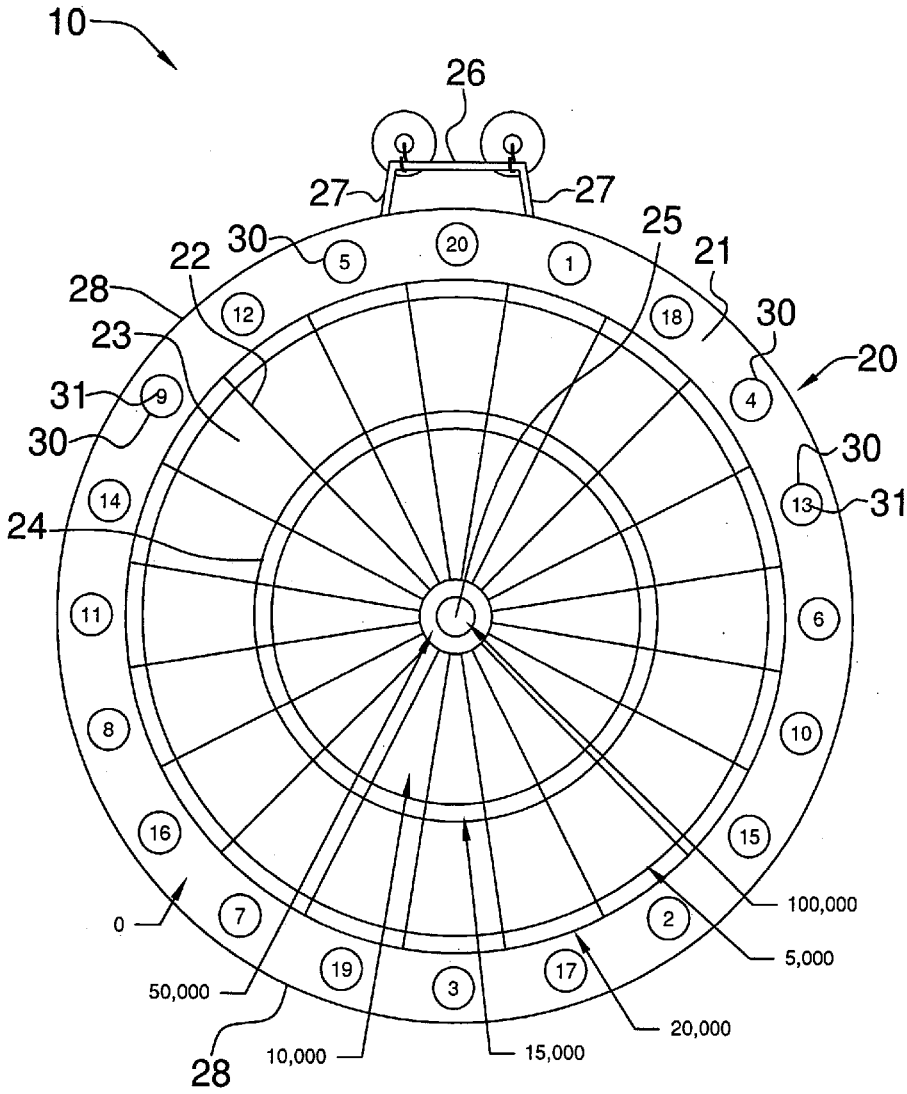
FIG. 5 is an enlarged front elevational view of the target shown in FIG. 1, illustrating the unique surface indicia displayed on the identification markers.

Initially referring to FIGS. 1, 3, and 5, the dart-board game kit 10 includes an annular target 20 including a front surface 21 provided with predetermined surface indicia 22 imprinted thereon for defining a plurality of pie-shaped regions 23 at which players may aim. The regions 23 are associated with a selected category unique to a business industry. The front target surface 21 has at least one concentric circle 24 and a coaxially registered bulls-eye 25 provided with a diameter smaller than a diameter of each concentric circle. The target 20 further includes a handle 26 having opposed end portions 27 attached to an outer perimeter 28 of the target 20 such that the target 20 can be vertically supported at an elevated position during game playing conditions. Such a target 20 is preferably formed from plastic, but may be formed from other light weight, durable materials such as wood, cork or foam.

Figure 4A:
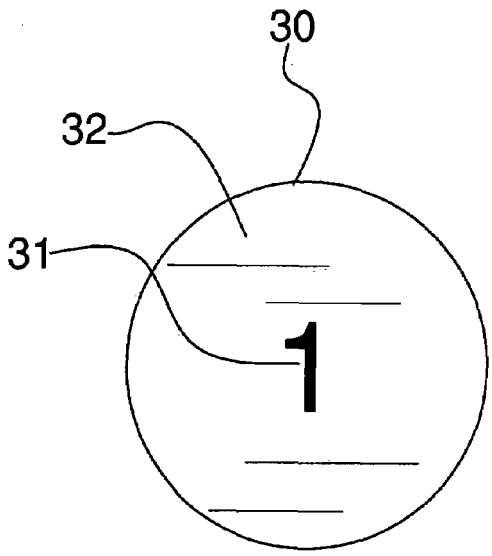
FIG. 4*a* is an enlarged front elevational view of an identification marker showing the indicia displayed on the front surface thereof.
Figure 4B:
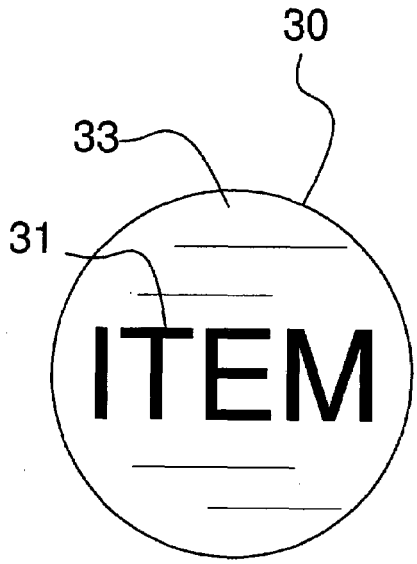
FIG. 4*b* is an enlarged rear elevational view of an identification marker showing the indicia displayed on the rear surface thereof.

Referring to FIG. 1, a plurality of mobile identification markers 30 are selectively attachable to the regions 23 for further defining a parameter of the business category for which each player must strive and each business goal is tailored to the business industry and company policies of the player's employer. The identification markers 30 include unique surface indicia 31 displayed on front 32 and rear 33 surfaces thereof such that the dart game can be tailored according to the business industry categories, as shown in FIGS. 4*a* and 4*b*. The identification markers 30 allow the dart-board kit 10 to be specifically tailored to the needs of a particular industry, increasing its versatility and expanding its potential market.

Still referring to FIG. 1, a plurality of projectiles 40 are removably engageable with the front surface 21. Each projectile 40 is assigned to an associated player such that a multitude of players can simultaneously track their goals on the target 20. The projectiles may be conventional throwing darts, or they may be spherical shaped objects having an exterior including hook and loop fastening material for removably engaging the target, as is obvious to one having ordinary skill in the art. The dart-board game kit 10 further includes a set of playing rules informing players how to play the game. Each player is required to stand a predetermined distance from the target 20 when throwing the projectiles 40 and each player is required to score hits in the regions 23 of the target 20 corresponding to their employment category with their employer. The players continue to throw the projectiles 40 until attaining an acceptable goal or reaching a maximum number of throws. Such a dart game preferably does not identify a winner, but rather improves employee motivation and work-related standards. A plurality of rectangular signs 50 may be adjustably positional on a ground surface and at selected distances from the target 20 for designating where each player must stand while throwing the projectiles 40 at the target 20, as shown in FIG. 1.

To play the game, an individual would first hang the target 20 on a wall in the same manner as a conventional dart board. The player would then label the outer perimeter 28 of the target 20 using the identification markers 30 provided with the kit 10. The markers 30 could represent dollar value sales totals an individual was attempting to reach, or they could represent the names of products an individual was attempting to sell, such as a particular vehicle model or piece of real estate. The individual would then throw a projectile 40 or series of projectiles 40 at the target 20 and see where they stick. The player would then attempt to generate the revenues or sell the products indicated by the markers 30 where the projectiles 40 have landed. When used in this manner, the dart-board game kit 10 would help motivate salespeople to set and achieve certain goals. Of course, the identification markers 30 could be used to create conventional scoring schemes or alternative scoring schemes for dart games, as is obvious to one having ordinary skill in the art.

The dart-board game kit 10 fulfills the need for a motivational dart game for individuals employed in sales. Such a kit 10 is easy to use, fun and easily customizable to a particular industry. When used in this manner, the dart-board game kit 10 could be advantageously utilized to motivate employees and enhance productivity.

Figure 2:
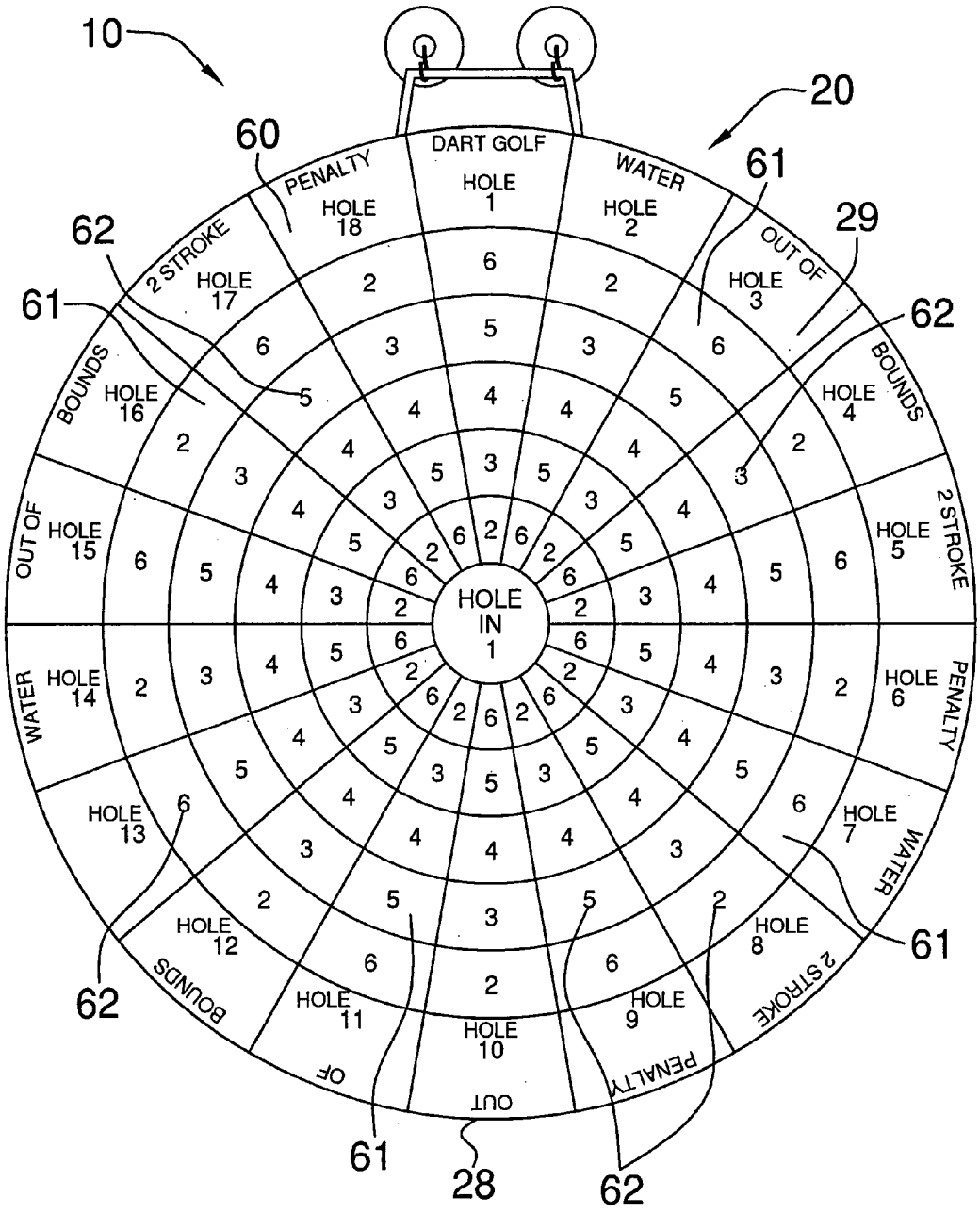
FIG. 2 is a rear elevational view of the target showing the rear target surface illustrating the golf course holes.

Now referring to FIG. 2, the target 20 preferably further includes a rear surface 29 provided with surface indicia 60 identifying a plurality of pie-shaped segments 61 associated with a plurality of golf course holes. The pie-shaped segments 61 are preferably registered about a center of the rear surface 29 and further are displayed in a chronological and clockwise order. Each of the pie-shaped segments 61 may further be parted along a radial path and define a plurality of adjacently disposed portions 62 having an associated numerical value identifying a number of swings for completing one of the golf course holes. The numerical values linearly increase towards the center of the rear surface 29 with the center representing a hole-in-one. Selected ones of the portions 62 are preferably juxtaposed along the outer perimeter 28 of the target 20 and further define at least one action selected from the group including hitting a golf ball into a body of water, hitting a golf ball out of bounds, and a 2-stroke penalty respectively. When playing the simulated golf game, a user may choose to throw the spherical shaped objects, so that playing a game of golf is better simulated.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A customizable dart-board game kit for promoting employee morale and camaraderie, said dart-board game kit comprising:

an annular target including a front surface provided with predetermined surface indicia imprinted thereon for defining a plurality of pie-shaped regions at which players may aim, said regions being associated with a selected category unique to a business industry, said front target surface having at least one concentric circle and a coaxially registered bulls eye provided with a diameter smaller than a diameter of said at least one concentric circle, said target further including a handle having opposed end portions attached to an outer perimeter of said target such that said target can be vertically supported at an elevated position during game playing conditions;

a plurality of mobile identification markers selectively attachable to said regions for further defining a parameter of the business category for which each player must strive, each business goal being tailored to the business industry and company policies of the player's employer;

a plurality of projectiles removably engageable with said front surface, each said projectile being assigned to an associated player such that a multitude of players can simultaneously track their goals on said target;

a set of playing rules informing players how to play the game, each player being required to stand a predetermined distance from said target when throwing said projectiles, each player being required to score hits in said regions of said target corresponding to their employment category with their employer, the players continuing to throw said projectiles until attaining an acceptable goal or reaching a maximum number of throws, wherein said dart game does not identify a winner but rather improves employee motivation and work-related standards; and a plurality of rectangular signs adjustably positional on a ground surface and at selected distances from said target for designating where each player must stand while throwing said projectiles at said target;

wherein said target further includes a rear surface provided with surface indicia identifying a plurality of pie-shaped segments associated with a plurality of golf course holes, said pie-shaped segments being registered about a center of said rear surface and further being displayed in a chronological and clockwise order, each pie-shaped segment further being parted along a radial path and defining a plurality of adjacently disposed portions having an associated numerical value identifying a number of swings for completing one of the golf course holes;

wherein the numerical values associated with alternating ones of said pie-shaped segments linearly increase towards the center of said rear surface, the center representing a hole-in-one;

wherein selected ones of the portions are juxtaposed along the outer perimeter of said target and further define at least one action selected from the group including; hitting a golf ball into a body of water, hitting a golf ball out of bounds and 2-stroke penalty respectively.

2. The dart-board game kit of claim 1, wherein said identification markers include unique surface indicia displayed on front and rear surfaces thereof such that said dart game can be tailored according to the business industry categories.

* * * * *